US007204800B2

(12) United States Patent
Easter et al.

(10) Patent No.: US 7,204,800 B2
(45) Date of Patent: Apr. 17, 2007

(54) IMPLANTABLE HEARING AID TRANSDUCER INTERFACE

(75) Inventors: James Roy Easter, Lyons, CO (US); Jose' H. Bedoya, Boulder, CO (US); Travis Rian Andrews, Boulder, CO (US)

(73) Assignee: Otologics, LLC, Boulder, CO (US)

( * ) Notice: Subject to any disclaimer, the term of this patent is extended or adjusted under 35 U.S.C. 154(b) by 0 days.

(21) Appl. No.: 11/406,056

(22) Filed: Apr. 17, 2006

(65) Prior Publication Data

US 2006/0281963 A1 Dec. 14, 2006

Related U.S. Application Data

(62) Division of application No. 10/703,672, filed on Nov. 7, 2003, now abandoned.

(51) Int. Cl.
*H04R 25/00* (2006.01)

(52) U.S. Cl. ..... 600/25

(58) Field of Classification Search ..... 600/25; 607/136, 137, 55–56; 181/128–129; 381/312–315, 381/322–329
See application file for complete search history.

(56) References Cited

U.S. PATENT DOCUMENTS

| | | | | |
|---|---|---|---|---|
| 6,293,903 | B1 | 9/2001 | Kasic, II et al. | 600/25 |
| 6,315,710 | B1 | 11/2001 | Bushek et al. | 600/25 |
| 6,482,144 | B1 | 11/2002 | Muller | 600/25 |
| 6,491,622 | B1 | 12/2002 | Kasic, II et al. | 600/25 |
| 6,517,476 | B1 | 2/2003 | Bedoya et al. | 600/25 |
| 6,537,199 | B1 | 3/2003 | Muller et al. | 600/25 |
| 6,705,985 | B2 | 3/2004 | Easter et al. | 600/25 |
| 2004/0147804 | A1 | 7/2004 | Schneider et al. | 600/25 |

*Primary Examiner*—John P. Lacyk
(74) *Attorney, Agent, or Firm*—Marsh Fischmann & Breyfogle LLP

(57) ABSTRACT

An implantable hearing aid transducer interface disposable between an implantable transducer and a mounting apparatus and having at least a portion that is displaceable in response to a predeterminable range of transducer movement. According to one aspect of the invention, the predeterminable range of transducer movement includes movement in response to a physiological movement of an auditory component that results in pressure on the implantable transducer. In this case, the compliant interface permits adaptive movement of the implantable transducer in response to the pressure to maintain a desired interface between the implantable transducer and an auditory component. According to another aspect, the predeterminable range of transducer movement may be transducer vibration resulting from an acoustic stimulation of an auditory component by the implantable transducer. In this case, the compliant interface reduces the transmission of transducer vibration over a feedback path to a microphone of a hearing aid.

20 Claims, 11 Drawing Sheets

IMPLANTABLE HEARING AID TRANSDUCER INTERFACE

CROSS-REFERENCE TO RELATED APPLICATIONS

This application claims priority as a divisional application to U.S. patent application Ser. No. 10/703,672 filed on Nov. 7, 2003 now abandoned, entitled "IMPLANTABLE HEARING AID TRANSDUCER INTERFACE". The foregoing application is incorporated herein by reference in its entirety.

FIELD OF THE INVENTION

The present invention relates to apparatus and methods for implanting hearing aid transducers, and in particular, to interface devices and methods for enhancing implantable transducer operation and maintaining a desired interface between the transducer and an auditory component of a patient.

BACKGROUND OF THE INVENTION

In the class of hearing aids generally referred to as implantable hearing aids, some or all of various hearing augmentation componentry is positioned subcutaneously on or within a patient's skull, typically at locations proximate the mastoid process. In this regard, implantable hearing aids may be generally divided into two sub-classes, namely semi-implantable and fully implantable. In a semi-implantable hearing aid, components such as a microphone, signal processor, and transmitter may be externally located to receive, process, and inductively transmit an audio signal to implanted components such as a transducer. In a fully-implantable hearing aid, typically all of the components, e.g. the microphone, signal processor, and transducer, are located subcutaneously. In either arrangement, an implantable transducer is utilized to stimulate a component of the patient's auditory system.

By way of example, one type of implantable transducer includes an electromechanical transducer having a magnetic coil that drives a vibratory actuator. The actuator is positioned to interface with and stimulate the ossicular chain of the patient via physical engagement. (See e.g. U.S. Pat. No. 5,702,342). In this regard, one or more bones of the ossicular chain are made to mechanically vibrate, causing the vibration to stimulate the cochlea through its natural input, the so-called oval window.

In the case of implantable transducers designed to interface with the ossicular chain, precise control of the engagement between the implantable transducer and the ossicular chain is important for proper transducer operation. For instance, stimulation of the ossicular chain, such as through vibration, relies at least in part on the appropriateness of the interface between the ossicular chain and transducer. Overloading or biasing of the implantable transducer relative to the ossicular chain can result in degraded performance of the biological aspect (movement of the ossicular chain) as well as degraded performance of the mechanical aspect (movement of the actuator). Similarly, if the implantable transducer is underloaded relative to the ossicular chain, e.g. a loose connection or no physical contact at all, vibrations may not be effectively communicated.

During implantation, a transducer, such as the one described above, is typically positioned proximate the ossicular chain such that a desired interface or contact with one of the ossicular bones, e.g. the incus, may be made. The transducer position is then fixed using a rigid mounting apparatus, such as a bone anchor, to maintain the position of the transducer and thereby the desired contact with the ossicular chain. As will be appreciated, however, such a system maintains the position of the implanted transducer relative to the ossicular chain, but does not maintain the position of the ossicular chain relative to the implanted transducer, such that an ossicular movement (other than those intentionally caused by the transducer) due to a physiological change may affect the interface between the ossicular chain and implanted transducer. In other words, ossicular movement due to a physiological change, referred to as a "physiological movement," may naturally occur because of a variety of circumstances including: changes in barometric pressure (e.g. caused by changes in altitude of the patient), tissue growth, swallowing, swelling after transducer implantation, and/or even clearing of the ears. Since the transducer is rigidly mounted, physiological movements of the ossicular chain may affect the interface with the transducer, e.g. resulting in an under or over loaded engagement with the transducer. This in turn may be realized in the patient by a "drop-off" in hearing function.

During normal operation of an implanted transducer, it is desirable to focus acoustic stimulation energy toward an auditory component (e.g. a component of a patient's biological hearing system) to be stimulated. It is also desirable to isolate the stimulation energy to minimize resonant phenomena due to re-amplification of feedback signals over a feedback path leading to the microphone. For instance, in the case of an implantable transducer mounted to a patient's skull as described above, vibrations from the transducer may be transmitted via the mounting system to the patient's skull and thereafter to the microphone when the transducer gain reaches a certain level. This in turn may limit the maximum gain available in a transducer, e.g. the higher the gain the higher the likelihood of resonant phenomena due to re-amplification of feedback signals. It is therefore desirable that the intensity of the vibration transmitted to the skull from an implantable transducer be reduced, making it possible to transmit a correspondingly larger intensity of vibration to a patient's middle ear without feedback. This in turn results in a higher maximum available gain in the transducer, and more efficient transducer operation.

SUMMARY OF THE INVENTION

In view of the foregoing, a primary object of the present invention is to improve transducer implantation and operation for semi and/or fully implantable hearing aids. Accordingly, another object of the present invention is to provide a means for maintaining a desired interface between an implanted transducer and a component of the patient's auditory system. A related object of the present invention is to provide a transducer interface that self compensates for "physiological movements" to maintain a desired interface with an auditory component, while permitting normal transducer operation, e.g. producing or enhancing desired sounds for a patient. A further related object of the present invention is to continuously provide such self-compensation subsequent to implantation of the transducer. Another object of the present invention is to isolate a microphone of the hearing aid from vibratory feedback over a conduction path from an implantable transducer.

According to one aspect of the present invention, a compliant interface for an implantable transducer is provided. The compliant interface is disposed between a mounting apparatus and the implantable transducer, which is in turn interfaced with an auditory component. In this regard, the compliant interface is displaceable in response to at least one predeterminable type of transducer movement.

In one embodiment of this aspect, one predeterminable types of transducer movement may be slow, gradual, or low frequency movements of the transducer ("low frequency movement"). For instance, such low frequency movement may be those that are less than 20 Hertz ("Hz"), more preferably less than 5 Hz, and even more preferably less than 1 Hz. Such movements may be caused by pressure applied on the transducer by a physiological movement of the interfaced auditory component.

According to another embodiment of this aspect, a second predeterminable type of transducer movement may be high frequency transducer vibrations, ("high frequency movement"). Such high frequency movements may be those vibratory movements that are in the audible frequency range of substantially 20 to 20,000 Hz, and more preferably within the range of 100 to 10,000 Hz, that result from vibratory stimulation of the interfaced auditory component during normal transducer operations.

Accordingly, in one embodiment of the present aspect, the compliant interface may comprise a resilient member having at least a portion thereof that is displaceable in response to the high frequency movements, while still permitting vibratory stimulation of the auditory component. In this arrangement, the compliant interface may be displaceable in response to the high frequency transducer movements so as to lesson the conduction of the transducer movements over a feedback path to a microphone of a hearing instrument (e.g. an externally-located or implanted microphone). In this case, the feedback path may include at least a portion of the mounting apparatus, such that the compliant interface is designed to lower a resonant frequency range between the transducer and the mounting apparatus. This in turn facilitates isolation of the mounting apparatus from transducer vibrations during operation of the transducer, while still permitting acoustic stimulation of the interfaced auditory component.

According to one characterization, the resilient member may comprise a viscoelastic material that includes a predeterminable damping coefficient to reduce the relative transmissibility of transducer vibrations through the compliant interface. In the present context, a viscoelastic material is characterized as a material possessing both viscous and elastic characteristics. This is in contrast to a purely elastic material that is characterized by a material wherein all of the energy stored during loading is returned when the load is removed. This is also in contrast to a purely viscous material that does not return any of the energy stored during loading. Rather, in a purely viscous material all the energy is lost, e.g. "pure damping," once the load is removed.

In this regard, material properties of viscoelastic materials are influenced by many parameters including frequency, temperature, dynamic strain rate, static pre-load, time effects such as creep and relaxation, ageing, and other irreversible effects. Advantageously, the present compliant interface is designed to have predeterminable stiffness and damping properties as a function of these parameters to provide supportable positioning of the transducer relative to an interfaced auditory component. In this regard, such supportable positioning is provided such that high frequency vibrations (e.g. in the audible frequency range) may be effectively communicated to the auditory component during normal operation of the transducer, while the compliant interface absorbs the high frequency transducer vibrations to isolate the mounting apparatus from the same.

In one example of the present characterization, the viscoelastic material may comprise an elastomeric material, e.g. such as silicone. According to this example, one or more anchor members may be provided to facilitate attachment of the viscoelastic material between a transducer mounting apparatus and the implantable transducer. In this regard, the quantity and geometric design of the anchor members may be selected to vary the damping coefficient of the compliant interface. It will be appreciated in this regard that a predetermined damping coefficient may be provided as a function of the operating frequency range of a given transducer, e.g. to reduce the relative transmissibility of transducer vibrations within the given operational frequency range of the transducer.

In another example of the present aspect, the resilient member may comprise a spring member that includes a predeterminable spring rate to reduce the relative transmissibility of transducer vibrations through the compliant interface to a mounting apparatus. In yet another example of the present characterization, the resilient member may be a combination of a viscoelastic material and a spring member. In any case, it will be appreciated that the present compliant interface provides a controlled compliance between an implantable transducer and a mounting apparatus that permits acoustic stimulation of an auditory component through vibrational energy, but reduces the transmissibility of transducer vibrations back to a microphone.

In another embodiment of the present aspect, the compliant interface may include a housing. The housing, in turn may contain a fluid therein that is displaceable within the housing to permit low frequency, slow or gradual movement of the transducer in response to pressure applied by the interfaced auditory component (e.g. during a physiological movement of the same) to maintain a desired interface between the transducer and the auditory component. In this regard, the fluid filled housing permits automatic in situ movement(s) of the implantable transducer to maintain the desired interface with the auditory component. In a further feature of this characterization, a compliant member that defines at least a portion of a wall of the housing is provided in a contact relationship with the implantable transducer. The compliant member is displaceable so as to communicate movements of the transducer to the fluid in the housing, thereby displacing the fluid within the same. In the context of the present aspect, the term "fluid" includes a liquid, a gas, or combination thereof, such that the housing of the compliant interface may include, a liquid, a gas, or a combination of a liquid and a gas, so long as it is displaceable therein.

In one arrangement, the housing may include first and second chambers defined therein. The first and second chambers are preferably axially aligned to reduce the real estate occupied by the compliant interface. In this regard, the first and second chambers may include a passage therebetween for fluid communication. According to this arrangement, the above-described compliant member may be located between the implantable transducer and the first chamber of the housing, while a second compliant member may be disposed in a distal end of the second chamber. Accordingly, movements of the implantable transducer in response to physiological movements of the auditory component are communicated to the fluid to create pressure differentials in the chambers, which result in displacement of the fluid therebetween through the passage. For instance, in response to a physiological movement of the auditory component in the direction of the transducer, the first compliant member may displace inward relative to the housing to displace at least a portion of the fluid from the first chamber to the second chamber, while the second compliant member displaces outward relative to the housing to compensate for the increased fluid in the second chamber. Similarly, in response to a physiological movement of the auditory component away from the transducer, the first compliant member may displace outward while the second compliant member displaces inward relative to the housing creating a pressure differential that draws at least a portion of the fluid from the second chamber into the first chamber. In this regard, in response to a movement of the auditory component toward an original position, the compliant members may displace at least a portion of the fluid between the chambers to gradually move the transducer with the auditory component back toward an original position.

The first and second compliant members may be any suitable members that permit movement of the transducer relative to the compliant interface. In one example according to this characterization, the first and second compliant members may be first and second bellows, respectively, that include a plurality of undulations to permit displacement both inward and outward relative to the housing, while maintaining a pressure equilibrium between the first and second chambers and the bellows. According to this characterization, the bellows are interconnected to the housing, e.g. about their periphery. In this regard, the undulations of the bellows permit displacement inward or outward of the same to displace the fluid, without imposing significant resistive forces, so that a state of equilibrium may be achieved in the compliant interface, e.g. fluid filled chambers and the bellows, regardless of whether the bellows are in a displaced state or neutral state. Advantageously this allows the compliant interface to remain in an accommodating position, e.g. in response to a pressure applied on the transducer by the auditory component, to maintain a desired interface without imposing a substantial resistive force on the transducer.

It will be appreciated that a compliant interface according to the above characterization, supportably positions the transducer relative to an interfaced auditory component such that high frequency vibrations (e.g. in the audible frequency range) may be effectively communicated to the auditory component during normal operation of the transducer. Similarly, the compliant interface displaces during a low frequency movement caused by pressure applied on the transducer by the auditory component during a physiological movement of the same.

The fluid disposed in the chambers may be any fluid compatible with the principles of the present invention. Preferably, the fluid is chosen based on properties such as, viscosity (in the case of liquid), and/or compressibility (in the case of a gas) required to achieve a desired time constant, e.g. responsiveness of the compliant interface to pressure applied on the transducer by the auditory component. For instance, the fluid is preferably bio-compatible and may be distilled water, silicone oil, mineral oil, or other de-ionized or sterile liquids. In this regard, it will be appreciated that three factors may independently affect the time constant or responsive characteristics of a compliant interface according to this characterization, namely, the size of the passage between the chambers, the viscosity of the fluid within the chambers, and a spring rate or memory of one or more components of the compliant interface. In the present context, the spring rate or memory refers to the tendency of a material to return to its original position after being deformed/displaced.

In this case, according to the above construction, a factor in selecting an appropriate fluid may be the size of the passage for communication of the fluid between the chambers. It will be appreciated in this regard, that given a known passage size a range of time constants for the compliant interface may be achieved by varying the viscosity of the fluid through fluid selection. Similarly, given a known viscosity, a range of time constants for the compliant interface may be achieved by varying the sized of the passage. Furthermore, for a given amount of spring rate or memory introduced into the compliant interface, a wide variety of time constants or response characteristics may be achieved by varying both the viscosity and the passage size.

In another characterization, the housing may include a third chamber preferably axially aligned with the first and second chambers. According to this arrangement, the second compliant member may define a wall between the second and third chambers. In this regard, the third chamber may include a resilient member, such as a spring or other biasing means, disposed between a distal end of the third chamber and the second compliant member. Accordingly, the resilient member may include a predetermined spring rate to provide a resistive force on the second compliant member to control the rate at which the gradual displacement of the fluid between the chambers occurs. Additionally, as will be discussed further below in relation to a second embodiment of the compliant interface, the introduction of a spring rate provides an additional functionality of damping high frequency transducer movements in the form of vibratory feedback between the transducer and a microphone of the hearing aid during normal operation of the transducer. In this regard, the resilient member not only controls the rate at which gradual displacements occur in response to physiological movements of an auditory component (low frequency transducer movements), but it also lowers the resonant frequency of the compliant interface to reduce feedback, e.g. during high frequency transducer movement, from the transducer to the microphone of the hearing aid.

In one example according to this arrangement, the resilient member may be connected to the second bellows, as well as to the distal end of the third chamber. In this case, the resilient member functions to control the gradual displacement both during a compressive force on the second bellows and an expansive force on the second bellows. In this regard, when the second bellows displaces in the direction of the resilient member, in response to movement of the transducer, the resilient member applies an opposing compressive force on the second bellows. Similarly, when the bellows displaces away from the resilient member, in response to movement of the transducer, the resilient member applies an opposing pulling force on the second bellows. In another example according to this arrangement, the resilient member may not be coupled to the second bellows, but merely positioned adjacent thereto. In this case, the resilient member may only function to control the rate at which the gradual displacement of the fluid between the chambers occurs when the second bellows displaces in the direction of the resilient member and combinations thereof.

According to another aspect of the present invention, an implantable transducer system is provided that includes an implantable transducer, a mounting apparatus, and a compliant interface. The mounting apparatus provides an interconnection between the implantable transducer and a patient's skull. The implantable transducer may include a distal actuator for forming a contact relationship with an auditory component to acoustically stimulate the same. The compliant interface, which may be any one of the above discussed characterizations, is disposed between the mounting apparatus and the implantable transducer and is displaceable in response to a predeterminable range(s) of transducer movement. As with the above aspect, in one embodiment, the predeterminable range of transducer movement may be a low frequency, slow or gradual movement of the transducer. As noted, such movement may be caused by pressure applied on the transducer by a physiological movement of the interfaced auditory component. According to another embodiment of this aspect, the predeterminable range of transducer movement may be a high frequency movement (e.g. in the operating frequency range of the transducer) of the transducer resulting from a vibratory stimulation of the interface auditory component during normal transducer operation.

According to another aspect of the present invention, a method for operating an implantable hearing aid transducer is provided. The method includes the steps of implanting a hearing aid transducer system including a compliant interface disposed between an implantable transducer and a mounting apparatus. The implanting step may include establishing a desired contact relationship between an actuator of the transducer and an auditory component of the patient. In this regard, the method may further include acoustically stimulating the auditory component using the transducer, and in response to a predeterminable type of movement, displacing at least a portion of the compliant interface.

According to a first embodiment of the present aspect, the predeterminable movement may be a low frequency or slow movement of the transducer. As noted above, such movement may be caused by pressure applied on the transducer by a physiological movement of the interfaced auditory component. In this regard, the displacing step may include displacing at least a portion of the compliant interface in response to a physiological movement of the auditory component to maintain the desired contact relationship between the actuator and the auditory component. According to this characterization, the displacing step may include communicating pressure applied on the transducer by the physiological movement of the auditory component to displace at least a portion of a compliant member disposed between a fluid filled housing and the transducer. This in turn may displace the fluid in the housing to accommodate the pressure on the transducer and maintain the desired interface between the transducer and auditory component. In this regard, the displacing step may include displacing the fluid between a first and second chamber of the housing to accommodate the pressure on the transducer. As noted above, the housing may include a passage of pre-determined dimension between the first and second chambers such that the method may further include varying at least one parameter of the compliant interface, e.g. the passage, the fluid, etc., to control the fluid displacement.

In another embodiment according to the present aspect, the predeterminable movement be a high frequency transducer movement resulting from the acoustical stimulation step. In this regard, the displacing step may include displacing at least a portion of the compliant interface to lessen the transmission of transducer vibrations over a conduction path between the transducer and the mounting apparatus. According to this embodiment, the displacing step may include displacing at least a portion of the compliant interface to substantially reduce or even eliminate transmission of transducer vibrations over the conduction path between the transducer and the mounting apparatus. In this regard, the displacing step effectively lowers the vibration transmission frequency range over the conduction path between the mounting apparatus and the implantable transducer, thereby isolating the output of the transducer.

Additional aspects, advantages and applications of the present invention will be apparent to those skilled in the art upon consideration of the following description and drawings.

DETAILED DESCRIPTION

Reference will now be made to the accompanying drawings, which at least assist in illustrating the various pertinent features of the present invention. In this regard, the following description is presented for purposes of illustration and description and is not intended to limit the invention to the form disclosed herein. Consequently, variations and modifications commensurate with the following teachings, and skill and knowledge of the relevant art, are within the scope of the present invention. The embodiments described herein are further intended to enable others skilled in the art to utilize the invention in such, or other embodiments, and with various modifications required by the particular application (s) or use(s) of the present invention.

Figure 1:
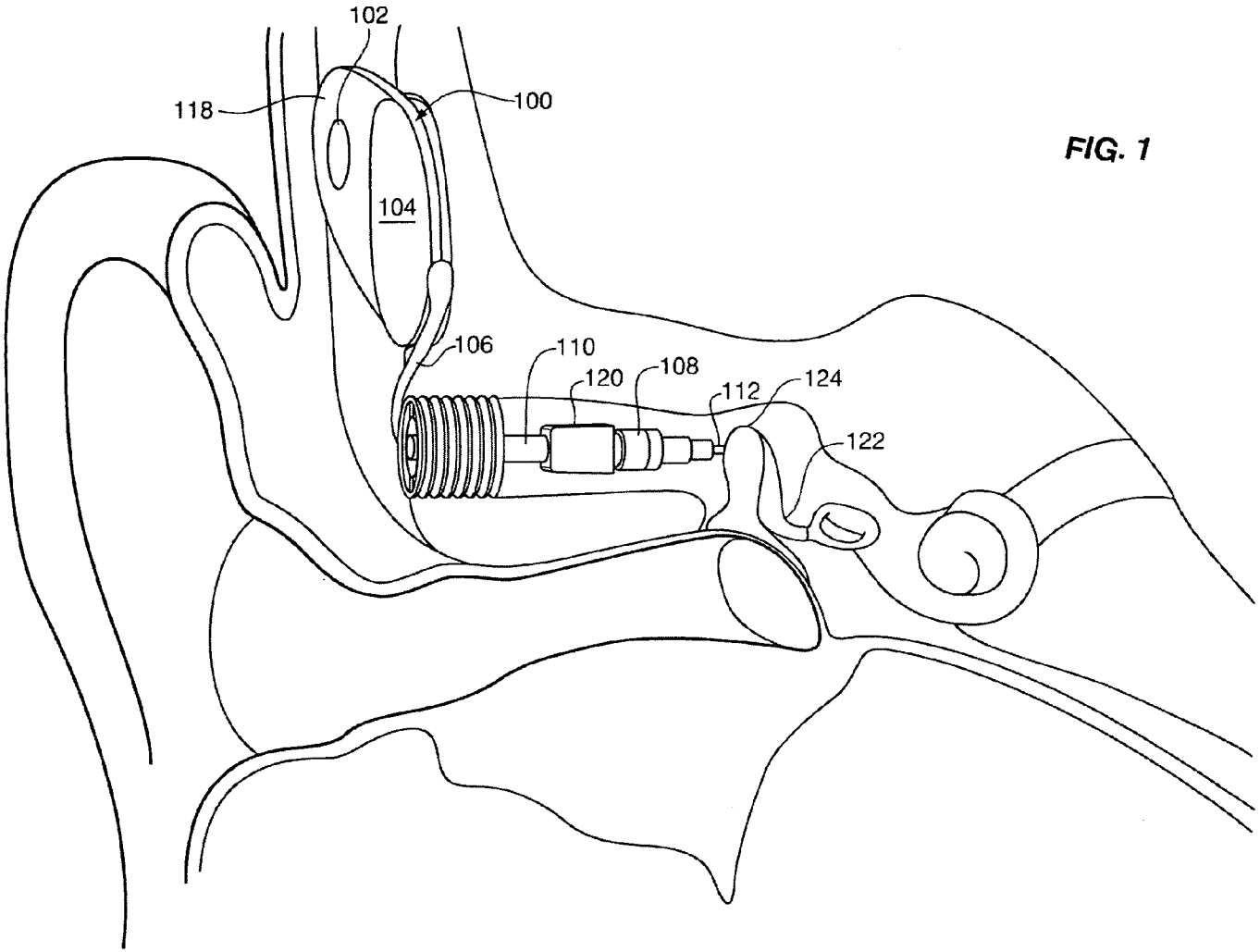
FIGS. 1 and 2 illustrate implantable and external componentry respectively, of a semi-implantable hearing aid device application of the present invention.
Figure 2A:
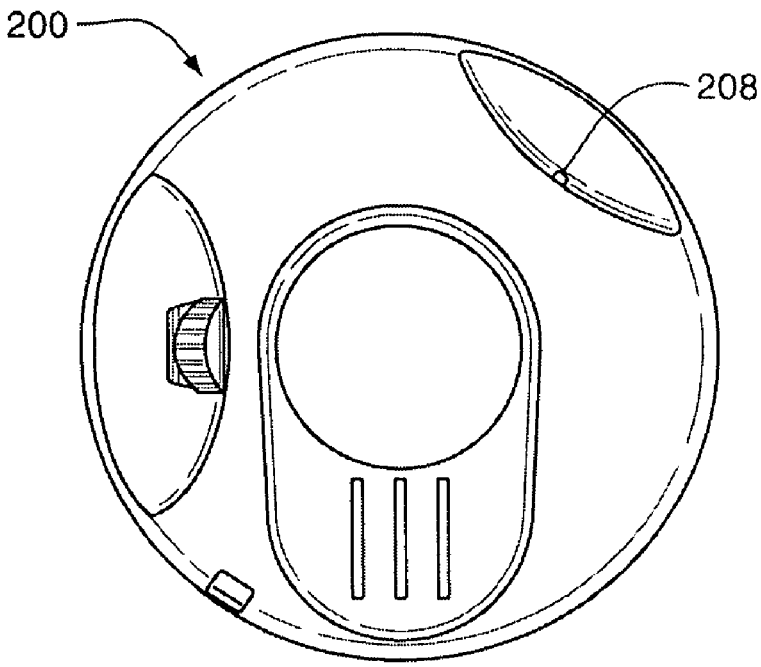
Figure 2B:
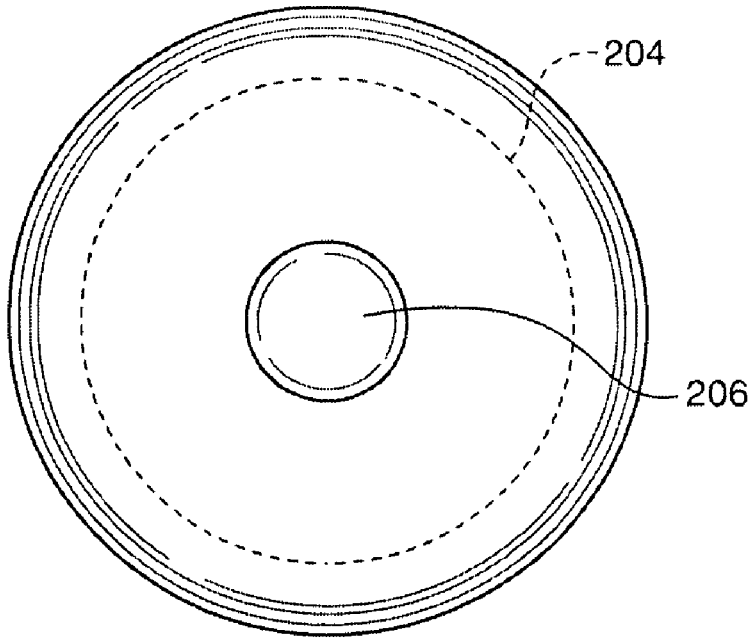

Hearing Aid System:

FIGS. 1 and 2 illustrate a semi-implantable hearing aid system having implanted components shown on FIG. 1, and external components shown on FIG. 2. As will be appreciated, the present invention may also be employed in conjunction with fully implantable systems, wherein all components of the hearing aid system are located subcutaneously.

In the illustrated system, an implanted biocompatible housing 100 is located subcutaneously on a patient's skull. The housing 100 includes an RF signal receiver 118 (e.g. comprising a coil element) and a signal processor 104 (e.g. comprising processing circuitry and/or a microprocessor). The signal processor 104 is electrically interconnected via wire 106 to a transducer 108. As will become apparent from the following description, various processing logic and/or circuitry may also be included in the housing 100 as a matter of design choice.

The transducer 108 may be any type of transducer that mechanically vibrates to stimulate a middle ear component, with some examples including but not limited to, an electromechanical, piezoelectric, or magnetic transducer. In this regard, the transducer 108 is supportably connected to a compliant interface 120. The compliant interface 120 is in turn connected to a mounting apparatus 110 mounted within the patient's mastoid process (e.g. via a hole drilled through the skull). The mounting apparatus 110 may be any one of a variety of anchoring systems that permit secure attachment of the transducer 108 in a desired position relative to a desired auditory component, e.g. the ossicular chain 122. As will be described in further detail below, the transducer 108 includes a vibratory actuator 112 for transmitting axial vibrations to a member of the ossicular chain 122 of the patient (e.g. the incus 124).

Referring to FIG. 2, the semi-implantable system further includes an external housing 200 comprising a microphone 208 and internally mounted speech signal processing (SSP) unit (not shown). The SSP unit is electrically interconnected to an RF signal transmitter 204 (e.g. comprising a coil element). The external housing 200 is configured for disposition rearward of the patient's ear. In this regard, the external transmitter 204 and implanted receiver 118 each include magnets, 206 and 102, respectively, to facilitate retentive juxtaposed positioning. In a fully-implantable embodiment an implanted microphone may be employed in place of microphone 208.

During normal operation, acoustic signals are received at the microphone 208 and processed by the SSP unit within external housing 200. As will be appreciated, the SSP unit may utilize digital processing to provide frequency shaping, amplification, compression, and other signal conditioning, including conditioning based on patient-specific fitting parameters. In turn, the SSP unit provides RF signals to the transmitter 204. Such RF signals may comprise carrier and processed acoustic drive signal portions. The RF signals are transcutaneously transmitted by the external transmitter 204 to the implanted receiver 118. As noted, the external transmitter 204 and implanted receiver 118 may each comprise coils for inductive coupling of signals therebetween. Upon receipt of the RF signals, the implanted signal processor 104 processes the signals (e.g. via envelope detection circuitry) to provide a processed drive signal via wire 106 to the transducer 108. The drive signals cause the actuator 112 to vibrate at acoustic frequencies to effect the desired sound sensation via mechanical stimulation of the ossicular chain 122 of the patient.

As noted above, acoustic stimulation of the ossicular chain 122, such as through vibration, relies at least in part on the appropriateness of the interface with the transducer 108 and particularly the actuator 112. Overloading or biasing of the actuator 112 relative to the ossicular chain 122 may result in degraded performance of the biological aspect (movement of the ossicular chain) as well as degraded performance of the mechanical aspect (movement of the actuator 112). Similarly, if the implantable actuator 112 is underloaded relative to the ossicular chain 122, e.g. a loose connection or no physical contact at all, vibrations may not be effectively communicated.

Figure 3:
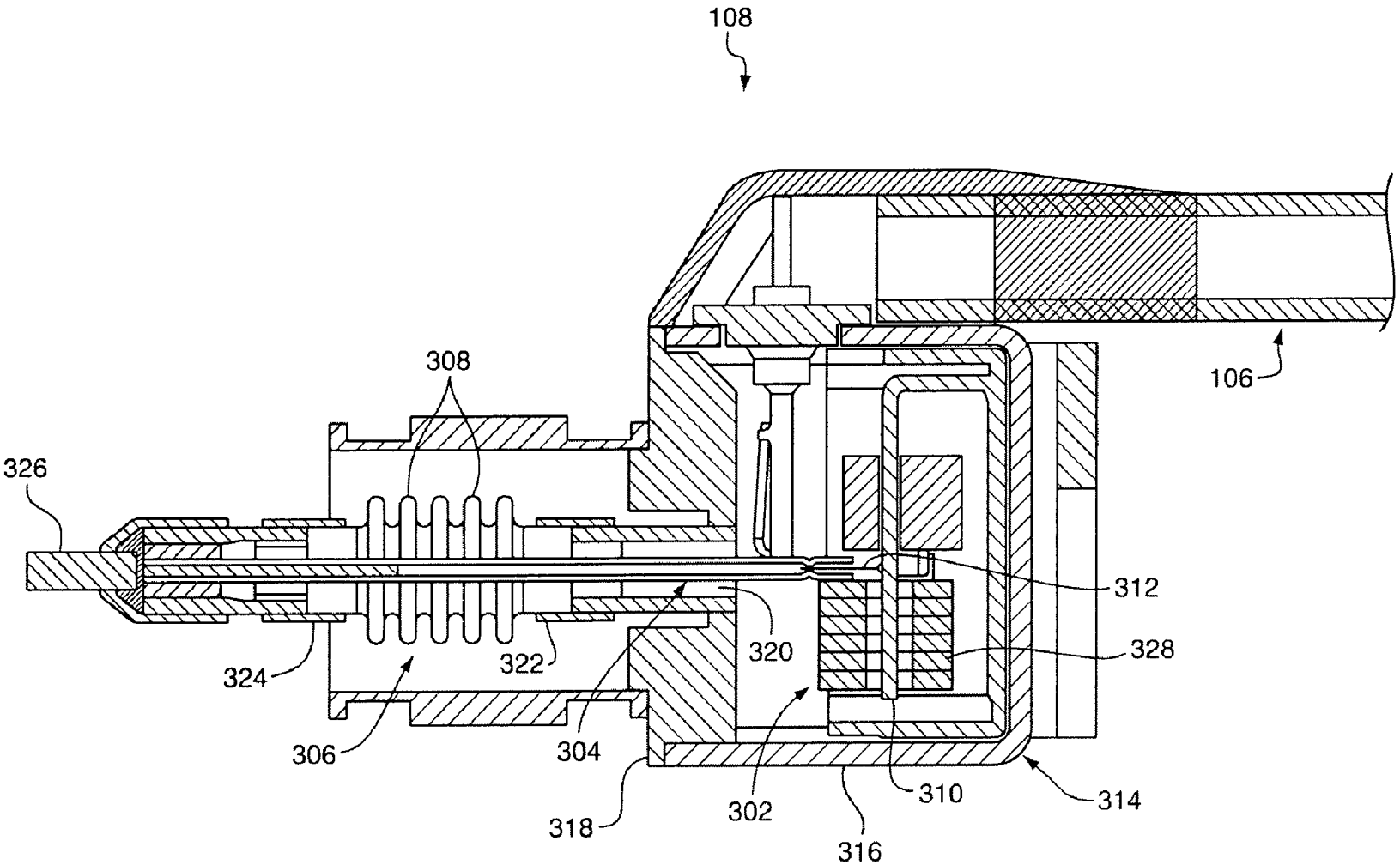
FIG. 3 illustrates an example of a transducer for a semi-implantable or fully implantable hearing aid device.

Hearing Aid Transducer:

It will be appreciated, that a compliant interface according to the present invention, may be utilized with a variety of transducer types as a matter of design choice. In this regard, FIG. 3 illustrates one example of the transducer 108 for purposes of illustration and not limitation. The transducer 108 includes an electromechanical driver 302, an elongated vibratory actuator 304 interconnected at a proximal end to the driver 302, and a cylindrical hollow bellows 306 interconnected at its distal end to a distal end of the vibratory actuator 304. In use, the vibratory actuator 304 includes a tip member 326 positioned within the middle ear of the patient to stimulate the ossicular chain 122. More particularly, driver 302 may selectively induce axial vibrations of vibratory actuator 304, which vibrations are in turn communicated to the incus bone 124 of the ossicular chain 122 via the tip member 326 to yield enhanced hearing. Bellows 306 comprises a plurality of undulations 308 that allow bellows 306 to axially respond in an accordion-like fashion to vibrations of the vibratory actuator 304. Of note, bellows 306 is sealed to provide for isolation of the internal componentry of transducer 108.

The electromechanical driver 302 comprises a leaf 310 extending through a plurality of coils 328. Coils 328 may be electrically interconnected to the signal processor 104 by means of the wire 106, which provides signals that induce a desired magnetic field across coils 328 to effect desired movement of leaf 310. In the illustrated example, leaf 310 is connected to a stiff wire 312, and vibratory actuator 304 is crimped onto the wire 312. As such, movement of leaf 310 affects axial vibration of vibratory actuator 304.

Driver 302 is disposed within a housing 314, comprising a main body 316 welded to a housing member 318. In order to effect the communication of axial vibrations, vibratory actuator 304 passes through an opening 320 of the housing member 318 and extends through the bellows 306. To maintain isolation of driver 302 within housing 314, bellows 306 is hermetically sealed and hermetically interconnected to the housing 314 at its proximal end 322 and to the vibratory actuator 304 at its distal end 324.

Compliant Interface:

The compliant interface 120 may be any device disposed between the implantable transducer 108 and the mounting apparatus 110, wherein at least a portion of the device is displaceable in response to a predeterminable movement(s) of the transducer 108. In this regard, the compliant interface 120 may be located at any location within the vibration pathway of the transducer 108. For example, the compliant interface 120 may be directly connected to the mounting apparatus 110 and/or the transducer 108. Alternatively, one or more intermediate components may be interconnected between the compliant interface 120 and the transducer 108 and/or between the compliant interface 120 and the mounting apparatus 110.

According to one aspect of the invention, the predeterminable movement may be low frequency movement of the transducer 108, e.g. a movement that is in response to a physiological movement of the ossicular chain 122. Such movement may be characterized as a low frequency or slow movement of the transducer caused by the gradual application of pressure applied on the transducer by a physiological movement of the interfaced auditory component. In this case, the compliant interface 120 may be any device that permits in situ compensatory movement of the transducer 108 in response to pressures resulting from the physiological movement of the ossicular chain 122, to maintain a desired interface between the actuator 112 and the ossicular chain 122. As noted above such physiological movements are movements of the ossicular chain, other than those intentionally caused by the transducer 108, that may occur naturally because of a variety of circumstances including: changes in barometric pressure, tissue growth, swallowing, swelling after transducer implantation, clearing of the ears, etc. For example, such a physiological movement of the ossicular chain 122 may be realized during a significant altitude change e.g. a visit to the mountains or flight in an un-pressurized airplane. In this case, the ossicular chain 122 may undergo a normal amount of movement relative to an implant position (position of the ossicular chain 122 when a desired interface between the actuator 112 and incus 124 was formed) due to the pressure change. This in turn, if not compensated for, may apply pressure on the transducer 108 affecting the interface between the actuator 112 and the incus 124, which may result in a degraded performance of the transducer 108 until a return to the original altitude causes the ossicular chain 122 to move back to the implant position.

According to a second aspect of the invention, the predeterminable movement of the transducer 108 may be a high frequency vibration during normal operation, e.g. acoustic stimulation of the ossicular chain 122. In this case, the predeterminable range of transducer movement may comprise all or a selected portion of the audible frequency range of 20 to 20,000 Hertz ("Hz"). In this regard, the compliant interface may be any device that reduces the transmissibility of such vibration back to the microphone 208 in the form of feedback. In one example according to this aspect, the compliant interface 120 may be disposed between the implantable transducer 108 and the mounting apparatus 110 to reduce the transmissibility of transducer vibrations to the mounting apparatus 110, and thereby to the microphone 208.

Figure 4:
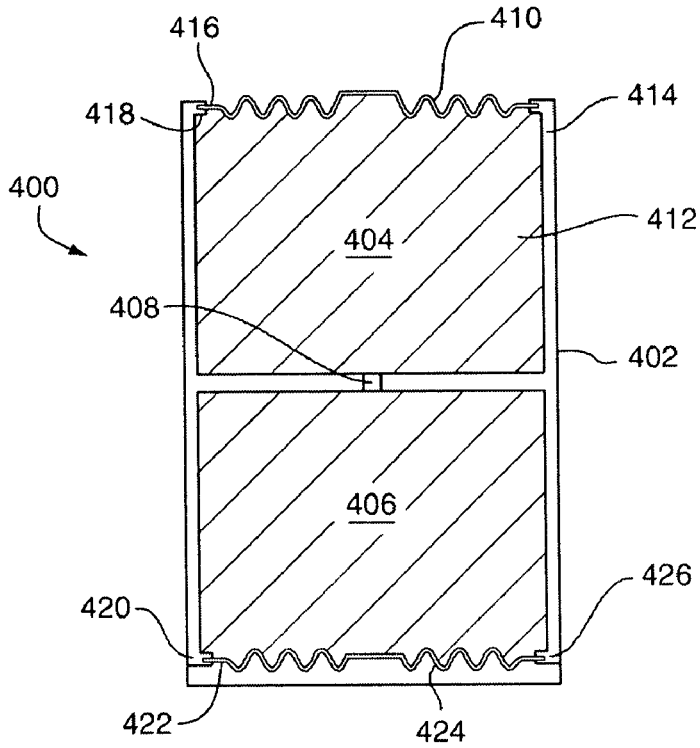
FIG. 4 illustrates an example of a compliant interface for an implantable transducer.
Figure 5:
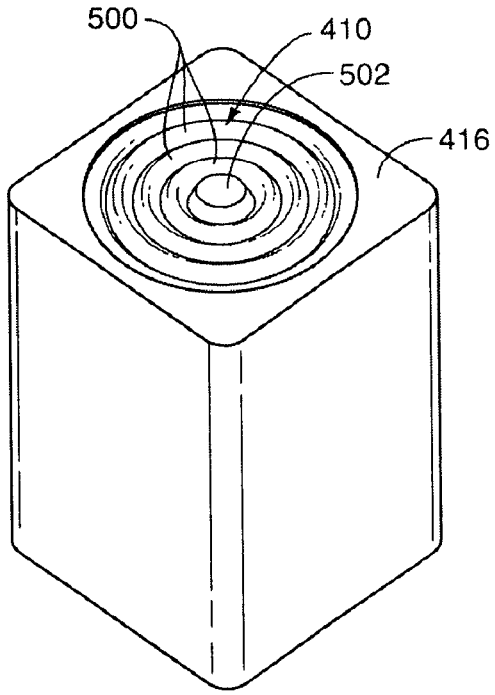
FIG. 5 illustrates an example of a first bellows for the compliant interface of FIG. 4.
Figure 6:
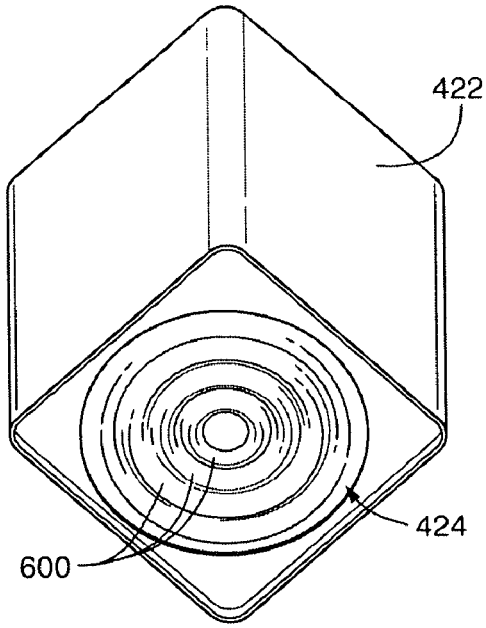
FIG. 6 illustrates an example of a second bellows for the compliant interface of FIG. 4.

Referring to FIGS. 4–6 an example of the compliant interface 120 according to the first aspect above is shown, namely compliant interface 400. The compliant interface 400 is designed to support an implantable hearing aid transducer, such as transducer 108, subcutaneously within a patient so that a contact interface may be formed with a middle ear component, such as the incus 124. Once in a supporting position, the compliant interface 400 is designed to automatically permit adaptive movements of the transducer 108 in response to pressure from physiological movements of the ossicular chain 122. It will also be appreciated the that compliant interface 400 may also permit adaptive movements of the transducer 108 to compensate for factors such as an improper alignment or positioning of the transducer 108 that occurs during implantation.

The compliant interface 400 includes a biocompatible housing 402 enclosing at least one and preferably a pair of axially aligned chambers, 404 and 406. The chambers, 404 and 406 are preferably axially aligned as illustrated on FIG. 4, to minimize the real estate occupied by the mount 400. The chambers, 404 and 406, include a fluid 412 filling the chambers, 404 and 406. The chambers, 404 and 406, are in turn in fluid communication with each other via passage 408 interconnecting the chambers, 404 and 406, to permit the fluid 412 to pass from one chamber to the other in response to pressure differentials caused by pressure from the transducer 108. In this regard, a compliant bellows 410 provides a seal in a distal end 414 of the chamber 404. Preferably, an outer diameter portion of the bellows 410 is disposed between a top 416 of the housing 402 and a top 418 of the chamber 404 such that the outer diameter is sandwiched therebetween. Such an arrangement accommodates the application and reliability of an overlapping electrodeposited layer (e.g. comprising a biocompatible material such as gold) disposed about the abutment region for interconnection and sealing purposes. Furthermore, such an arrangement also provides for the supportable interconnection of the chamber 404 and the housing 402 at the end 414. Similarly, a second compliant bellows 424 provides a seal in a distal end 426 of the chamber 406. As with the bellows 410, the bellows 424 is disposed between a bottom 422 of the housing 402 and a bottom 420 of the chamber 406. As noted above, the outer diameter of the bellows 424 may be sandwiched therebetween with an electrodeposited layer disposed in the abutment region for interconnection and sealing purposes, as well as support for the chamber 406 within the housing 402 at the end 422. According to this characterization, support for the chambers, 404 and 406, at their distal ends may be provided by the interconnection provided by the passage 408.

Referring to FIG. 5, a top plan view of the interface 400 including the bellows 410 is shown. Referring to FIG. 6, a bottom plan view of the chamber 406 with the bottom 422, of housing 402, removed to illustrate the bellows 424, is shown. The bellows, 410 and 424, may be constructed from any compliant material according to the principles of the present invention. Preferably, however, the bellow members, 410 and 424, are made from positively stable materials such as, nickel and gold, so as to resist oscillations when a subject force is applied or removed. In this regard, the bellows 410 provides an interface 502 for forming a pivotal contact relationship with the transducer 108. The interface 502 may be a centrally located planar surface that is affixed to the distal end of the transducer 108 by any suitable means, such as a biocompatible adhesive, electrodeposition bond, or weld. Alternatively, however, the transducer 108 may not be physically connected to the bellows 410 but may only be adjacently positioned to form the contact relation therebetween.

In an alternative example, the end 422 of the compliant interface 400 may be connected to the transducer 108 while the bellows 410 is in a contact relation with the mounting apparatus 110 to form the pivotal contact relation therebetween. In other words, it will be appreciated that at least one compliant member, e.g. one of the bellows 410 and 424, should physically engage either the transducer 108 or the mounting apparatus 110, such that a pivotal contact relation is established therebetween to accommodate pressure applied on the transducer 108 as a result of physiological movements of the incus 124.

According to the present embodiment, it is desirable to minimize the amount of material memory present in the compliant interface 400, and in particular the bellows 410 and 424. In this regard, material memory refers to the tendency of a material to return to its original position after being deformed. Accordingly, the bellows 410 and 424 include a plurality of undulations 500 and 600 respectively to permit displacement of the same to displace the fluid 412 between the chambers 404 and 406, without imposing significant resistive forces on the fluid 412 due to material memory. This in turn, permits a state of equilibrium to exist in the compliant interface 400, e.g. within the chambers 404 and 406, as well as at the bellows 410 and 424, even when the bellows are in a displaced state and the fluid 412 is partially displaced between the chambers 404 and 406. Advantageously this allows the compliant interface 400 to remain in an accommodating position, e.g. in response to a pressure applied on the transducer 108 by the incus 124, to maintain a desired interface without imposing a substantial resistive force on the transducer 108 and ultimately on the incus 124.

Figure 7:
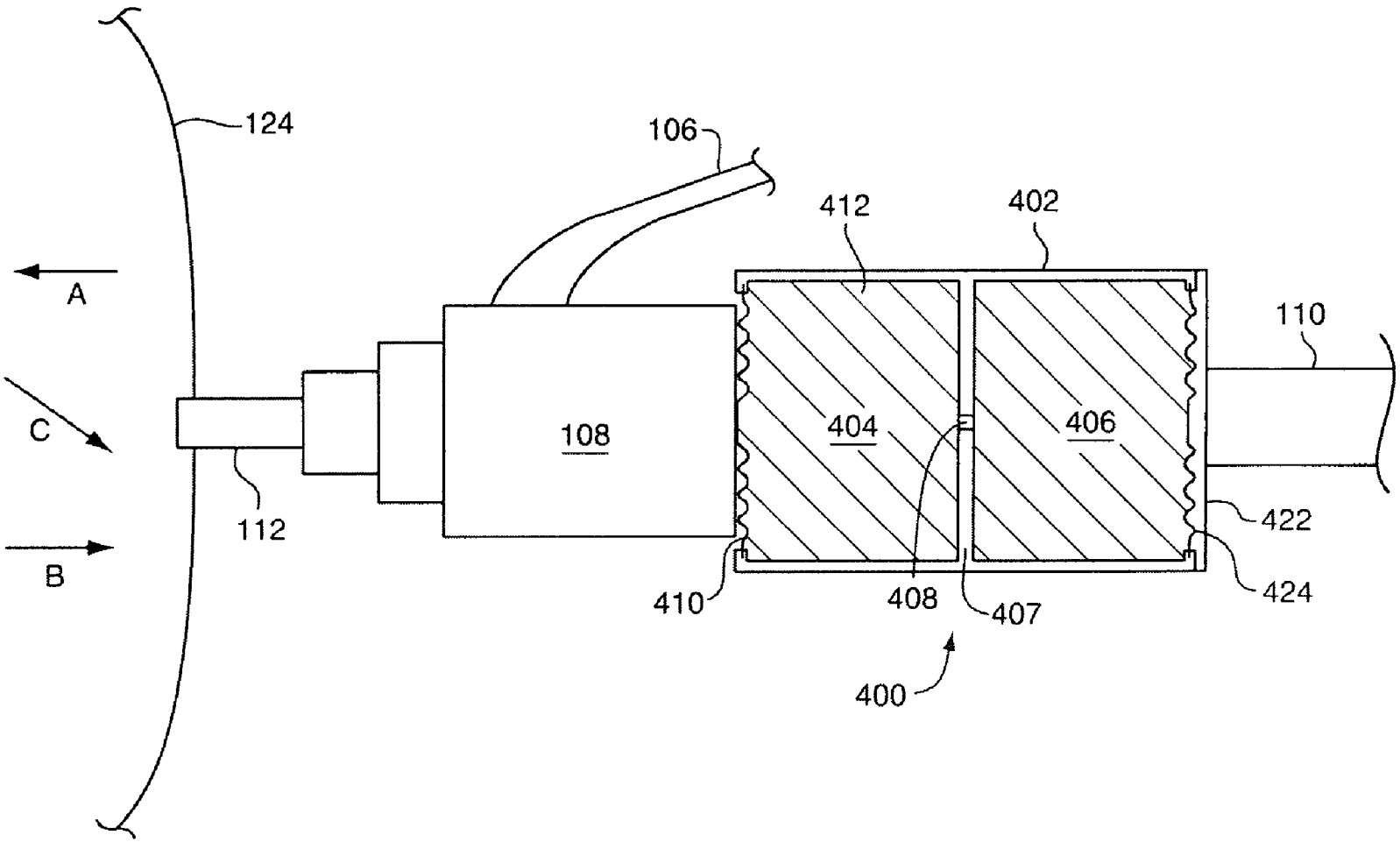
FIG. 7 illustrates an operational protocol for the compliant interface of FIG. 4.

An exemplary operation of the present invention will now be described with reference to FIG. 7. As shown on FIG. 7, the transducer 108 interconnects at its proximal end to the compliant interface 400, and specifically to the bellows 410. At its distal end, the transducer 108 engages the incus 124 via the vibratory actuator 112. The compliant interface 400 is in turn rigidly connected to the mounting apparatus 110, which is connected to the patient's skull. According to this characterization, the compliant interface 400 permits adaptive movement of the transducer 108 in response to corresponding physiological movements of the ossicular chain 122. In this regard, the transducer 108 is supportably interconnected at its proximal end by the bellows 410 and engages the incus 124 at its distal end, such that the transducer 108 may efficiently transmit axial vibrations to the incus 124 in response to transducer drive signals received over the wire 106 from the processor 104. In contrast, however, in response to a gradual movement of the incus 124 due to, for example, a change in barometric pressure or other cause, the transducer 108 is movable by the incus 124 relative to the compliant interface 400 and in particular the bellows 410. For instance, in response to a movement of the incus 124 in the direction B, a gradual force is applied on the actuator 112, which is transmitted through the transducer 108 as a mechanical pressure on the bellows 410. This in turn causes an inward displacement of the bellows 410 relative to the chamber 404 that pressurizes the chamber 404 causing fluid flow from the chamber 404 to the chamber 406 via passage 408. The resulting fluid flow, in turn, pressurizes the chamber 406 causing a displacement of the bellows 424 toward the bottom 422 of the compliant interface 400.

As the pressure applied on the transducer 108 from the incus 124 is relaxed, the bellows 424 and the transducer 108 move with the incus 124 back toward an original position, exerting an opposite force on the fluid 412 in the chamber 404 and 406. This in turn pressurizes the chamber 406 and gradually moves at least a portion of the fluid 412 back into the chamber 404 until a state of equilibrium is reached between the chambers, 404 and 406 as the pressure on the transducer 108 is relaxed. Similarly, the opposite is true in the event of a movement in the direction A, by the incus 124. In this case, the bellows 410 displaces as the transducer 108 moves in the direction A with the incus 124 creating a pressure differential between the chambers, 404 and 406 resulting in at least a portion of the fluid 412 flowing through the passage 408 from the chamber 406 to the chamber 404. In contrast, as the pressure applied on the transducer 108 is relaxed, the bellows 410 exerts an opposite force on the fluid 412 in the chamber 406 thereby moving the fluid back through the passage 408 from the chamber 404 into the chamber 406 until a state of equilibrium is reached between the chambers, 404 and 406.

It will also be appreciated that similar pressure differentials are created by combinations of axial and angular movements of the transducer 108 relative to the interface 400, and specifically the bellows 410. For instance a force on the transducer 108 in the direction C will result in a similar scenario as the first example described above, although movement of the bellows 410 will be less uniform, e.g. the corner of the transducer 108 will project the greatest force on the bellows 410. In this manner, the compliant interface 400 provides a U-Joint type connection between the transducer 108 and an auditory component of the patient permitting both angular and axial movements of the transducer 108 relative thereto.

Advantageously, the compliant interface 400 also accommodates, in a similar manner, conditions such as misalignment of the transducer 108 during implantation. For instance, if the transducer 108 is overloaded relative to the incus 124 during implantation, the compliant interface 400 permits an accommodating movement of the transducer 108, thereby relaxing the pressure on the ossicular chain 122, such that a desired interface is provided between the actuator 112 and incus 124.

Figure 8:
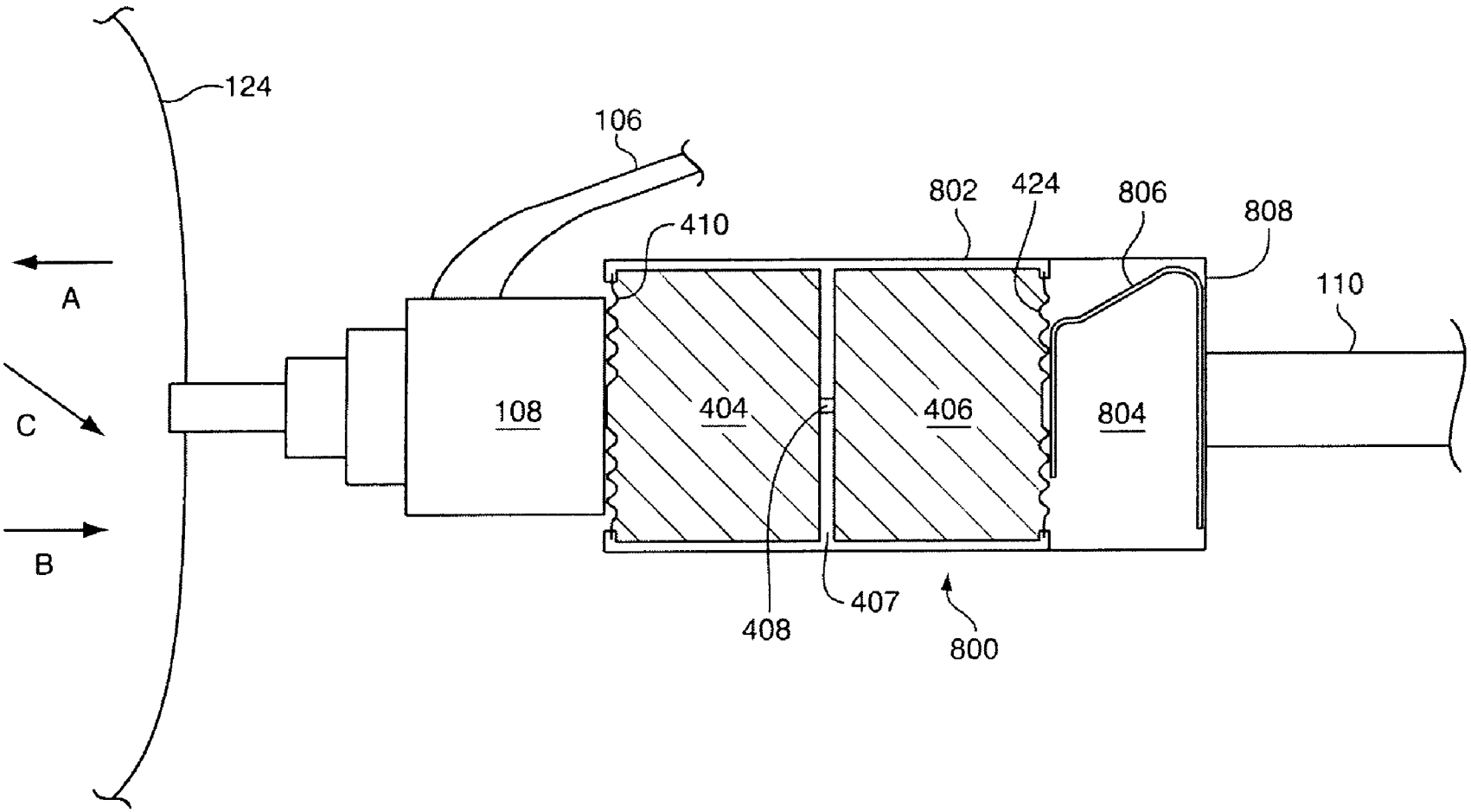
FIG. 8 illustrates another example of a compliant interface for the transducer of FIG. 3.

Referring to FIG. 8, another example of the compliant interface 120 according to the present invention is shown, namely compliant interface 800. The compliant interface 800 is substantially similar to the compliant interface 400 in that it includes a biocompatible housing 802, axially aligned chambers 404 and 406 in fluid communication via passage 408, bellows 410, and bellows 424. In contrast, however, the compliant interface 800 further includes a third chamber 804 having a resilient member, e.g. spring 806, disposed therein between a bottom 808 of the chamber 804 and the bellows 424.

The compliant interface 800, according to this embodiment, operates similarly to the compliant interface 400 to permit movement of the transducer 108 in response to physiological movement of the ossicular chain 122. In this characterization, however, the spring 806 functions to control the gradual displacement of the bellows 424 by the fluid 412. In one example according to this characterization, the spring 806 may be coupled to the bellows 424 by an appropriate means such as an adhesive or heat stake. In this case, the spring 806 functions to control the rate at which the gradual displacement of the fluid 412 between the chambers 404 and 406 occurs both when the bellows 424 displaces in the direction of the spring 806 and when the bellows 424 displaces away from the spring 806. In other words, the spring 806 applies a compressive force on the bellows 424 during displacement toward the spring 806 and an opposing force, e.g. pulls on the bellows 424, during displacement away from the spring 806.

In another example, the spring 806 may not be coupled to the bellows 424, but merely positioned adjacent thereto. In this case, the spring 806 only functions to control the rate at which the gradual displacement of the fluid occurs during a displacement of the bellows 424 toward the spring 806. In response to movement of the transducer 108 in the direction A, the spring 806 would not act on the bellows 424 nor effect the return of the bellows 424 during a relaxation of pressure on the transducer 108.

In any case, as will be discussed further below in relation to a second embodiment of the compliant interface, the introduction of a spring rate or memory into the compliant interface 120 provides an additional functionality of damping high frequency transducer movements between the transducer 108 and a microphone 208 of the hearing aid during normal operation of the transducer 108. In other words, the spring 806 provides a predeterminable amount of damping in the compliant interface 800, which operates to lesson the transmission of vibrations over the same. In this regard, the compliant interface 800 not only controls the rate at which gradual displacements occur in response to physiological movements of an auditory component (low frequency transducer movements), but it also lowers the resonant frequency of the compliant interface 800 to reduce feedback, e.g. during high frequency transducer movement, from the transducer 108 to the microphone 208 of the hearing aid.

The fluid 412 may be any fluid compatible with the principles of the present invention. Preferably, the fluid 412 is chosen based on properties such as, viscosity (in the case of liquid), and/or compressibility (in the case of a gas) required to achieve a desired time constant, e.g. responsiveness of the compliant interface 120 to pressure on the transducer 108. For instance, the fluid is preferably biocompatible with some examples including without limitation, distilled water, silicone oil, mineral oil, or other de-ionized or sterile liquids. In this regard, it will be appreciated that at least three factors may independently affect the time constant or responsive characteristics of the present compliant interface 120, namely, the size of the passage 408 between the chambers 404 and 406, the viscosity of the fluid 412 within the chambers 404 and 406, and a spring rate or memory of one or more components of the compliant interface 120, e.g. the addition of the spring 806. Thus, according to the above construction, a factor in selecting an appropriate fluid 412 may be the size of the passage 408 for communication of the fluid 412 between the chambers 404 and 406. It will also be appreciated in this regard, that given a known passage size, a range of time constants for the compliant interface 120 may be achieved by varying the viscosity of the fluid 412 through fluid selection. Similarly, given a known viscosity, a range of time constants for the compliant interface 120 may be achieved by varying the size of the passage 408. Furthermore, for a given amount of spring rate or memory introduced into the compliant interface 120, a wide variety of time constants or response characteristics may be achieved by varying both the viscosity and the passage size.

In one example of the present embodiment, a desired time constant may be in the range of 0.1 to 10 seconds and more preferably is in the range of 5 to 10 seconds and still more preferably around 10 seconds. Such an arrangement provides a compliant interface 120 that is unlikely to impose a significant force on the transducer 108 during a physiological movement of the ossicular chain 122 and permits normal vibratory stimulation of the incus 124 during operation of the transducer 108.

In this regard, for the case where a viscous fluid flows through the passage 408, and where the passage 408 is of sufficient length that established flow may be assumed, the flow rate or time constant may be determined by the following formula:

$$q = \frac{\pi d^4}{128\,\mu L}(p_1 - p_2)$$

in this case $q$ = the volumetric flow rate of the liquid
$d$ = the diameter of the passage 408
$L$ = the length of the passage
$\mu$ = the dynamic viscosity of the liquid
$p1 - p2$ = the pressure differential driving the flow According to the above-described principles, it is desired that the displacement of the transducer 108 with time x(t) be such that the transducer 108 adapts to physiological ossicular movement within a brief time, e.g. on the order of seconds. This displacement may be found by solving the following equation relating movement of the transducer 108 to the rate of flow through the passage 408.

$$x'(t) = (1/A_1)\frac{\pi d^4}{128\,\mu L}\left(\frac{f_1}{A_1} - \frac{kx(t)}{A_2}\right)$$

in this case

-continued $A_1$ = the area of the cylinder adjacent to the transducer
$A_2$ = the area of the cylinder adjacent to the holding spring
$f_1$ = the force applied to the transducer
$k$ = the spring rate of the holding spring For the initial condition where x(0)=0, the solution to the equation is simply:

$$x(t) = \frac{A_2 f_1\left[1 - \exp\left(\frac{-d^4 k\pi t}{128 A_1 A_2 L\mu}\right)\right]}{A_1 k}$$

Figure 9:
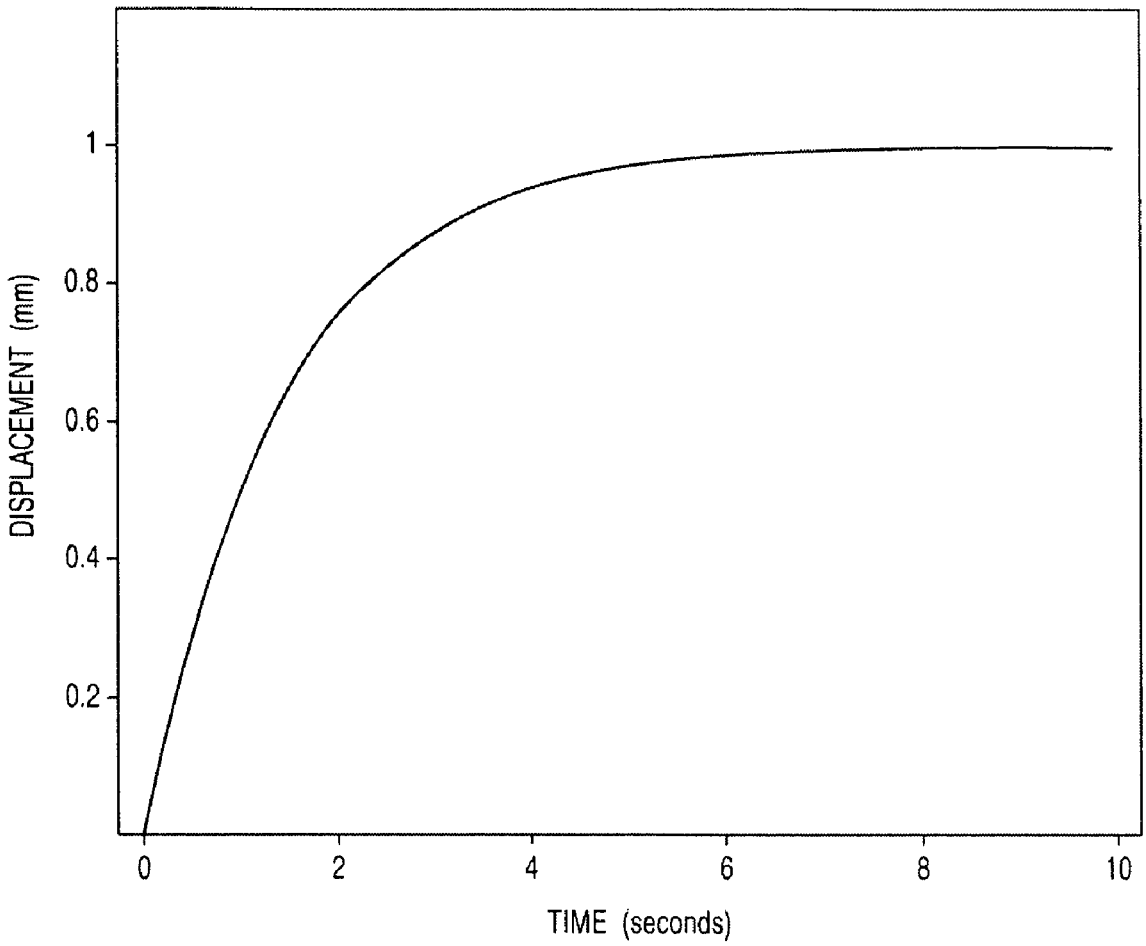
FIG. 9 illustrates displacement of a transducer with time according to one example of a compliant interface.

FIG. 9 illustrates displacement of the transducer 108 with time according to following values for the above parameters:

$A_1$=28.3 mm$^2$ (a cylinder 6 mm in diameter)
$A_2$=28.3 mm$^2$ (chosen to be similar to $A_1$; other values are possible)
$f_1$=1000 dynes
k=1000 dynes/mm
d=0.2 mm
L=1 mm
$\mu$=6.924×10$^{-4}$ kg/m-sec (the dynamic viscosity of water at 37° C.)

Those skilled in the art will appreciate that numerous parameter combinations may be chosen to achieve various different time constants, e.g. response characteristics of the compliant interface 120. Therefore, it should be expressly understood that the above example is given for purpose of illustration and not limitation. Alternatively, in some applications it may be desirable to use a non-compressible fluid 412 in combination with a small amount of compressible gas such as air. In this characterization, the compressible gas will permit a subtler re-positioning of the transducer 108 relative to the compliant interface 120 as compression of the gas occurs before significant pressure differentials are generated in the chambers, 404 and 406. In this regard, it will be appreciated that various different combinations of compressible gas and non-compressible fluids are determinable to achieve a variety of response characteristics in the transducer mounts 400 and 800.

Referring to FIGS. 10–13 another example of the compliant interface 120 according to the second aspect above is shown, namely compliant interface 1000. As noted according to this aspect, one predeterminable type of transducer movement may be high frequency transducer vibration e.g. within the audible frequency range of 20 to 20,000 Hertz, resulting from a vibratory stimulation of the interfaced auditory component during normal operation of transducer 108.

In this regard, the compliant interface 1000 according to this aspect, operates as a passive vibration isolation system to isolate the microphone 208 of the hearing aid from transducer vibrations during operation of the transducer 108. Thus, the compliant interface 1000 includes a compliant member having a predeterminable spring rate and damping coefficient, disposed between the transducer 108 and the mounting system 110. In this arrangement, the compliant interface 1000 may be displaceable in response to the high frequency transducer movements so as to lesson the conduction of the same over a feedback path to a microphone of a hearing aid. In this case, the feedback path may include at least a portion of the mounting apparatus 110. In this regard, the compliant interface is designed to lower a resonant frequency range between the transducer 108 and the mounting apparatus 110. This in turn facilitates isolation of the mounting apparatus 110 from transducer vibrations during operation of the transducer 108.

In one example according to this aspect, the compliant interface 1000 may comprise a viscoelastic material that includes a predeterminable spring rate and damping coefficient to reduce the relative transmissibility of vibrations from the transducer 108 through the compliant interface 1000. In the present context, a viscoelastic material is characterized as a material possessing both viscous and elastic characteristics. This is in contrast to a purely elastic material, which is characterized as one wherein all of the energy stored during loading is returned when the load is removed and a purely viscous material, which does not return any of the energy stored during loading. Rather, in a purely viscous material all the energy is lost, e.g. "pure damping," once the load is removed.

According to one particular example, the viscoelastic material may be a viscoelastic material 1002, e.g. silicone, disposed within a housing 1006. According to this example, an anchor 1004 vertically extending from a top 1008 of the transducer 108 couples the housing 1006 and transducer 108. The anchor 1004 may optionally include a geometric configuration, such as the expanded head 1014, illustrated on FIG. 10, to facilitate coupling between the housing 1006 and transducer 1008. As will be further appreciated from the following description, the anchor 1004 may optionally include the geometric configuration, e.g. expanded head 1014, to provide a predetermined spring rate and damping coefficient and/or structural stability in the compliant interface 1000.

The housing 1006, provides an interface for connection of the transducer 108 to the mounting apparatus 110. In one example of such an interface, the mounting apparatus 110 may include a foot member 1012 that slidably engages a slot 1014 in the top of the housing 1006. In this regard, the housing 1006 may substantially enclose the viscoelastic material 1002 to enhance the supportable relationship between the transducer 108 and the mounting apparatus 110. The housing 1006, however, stops short of contacting the transducer 108 in that a space or gap 1010 is provided between the transducer top 1008 and the housing 1006. In this regard, the gap 1010 prevents significant conduction of vibratory movements from the transducer 108 to the housing 1006 other than through the viscoelastic material 1002, which is provided to substantially isolate such movements from transmission to the mounting apparatus 110. In an alternative example of the present compliant interface 1000, the housing 1006 may include an aperture 1016 or opening through which wire 106 may be provided to the transducer 108, e.g. for providing transducer drive signals from the signal processor 104.

Figure 11:
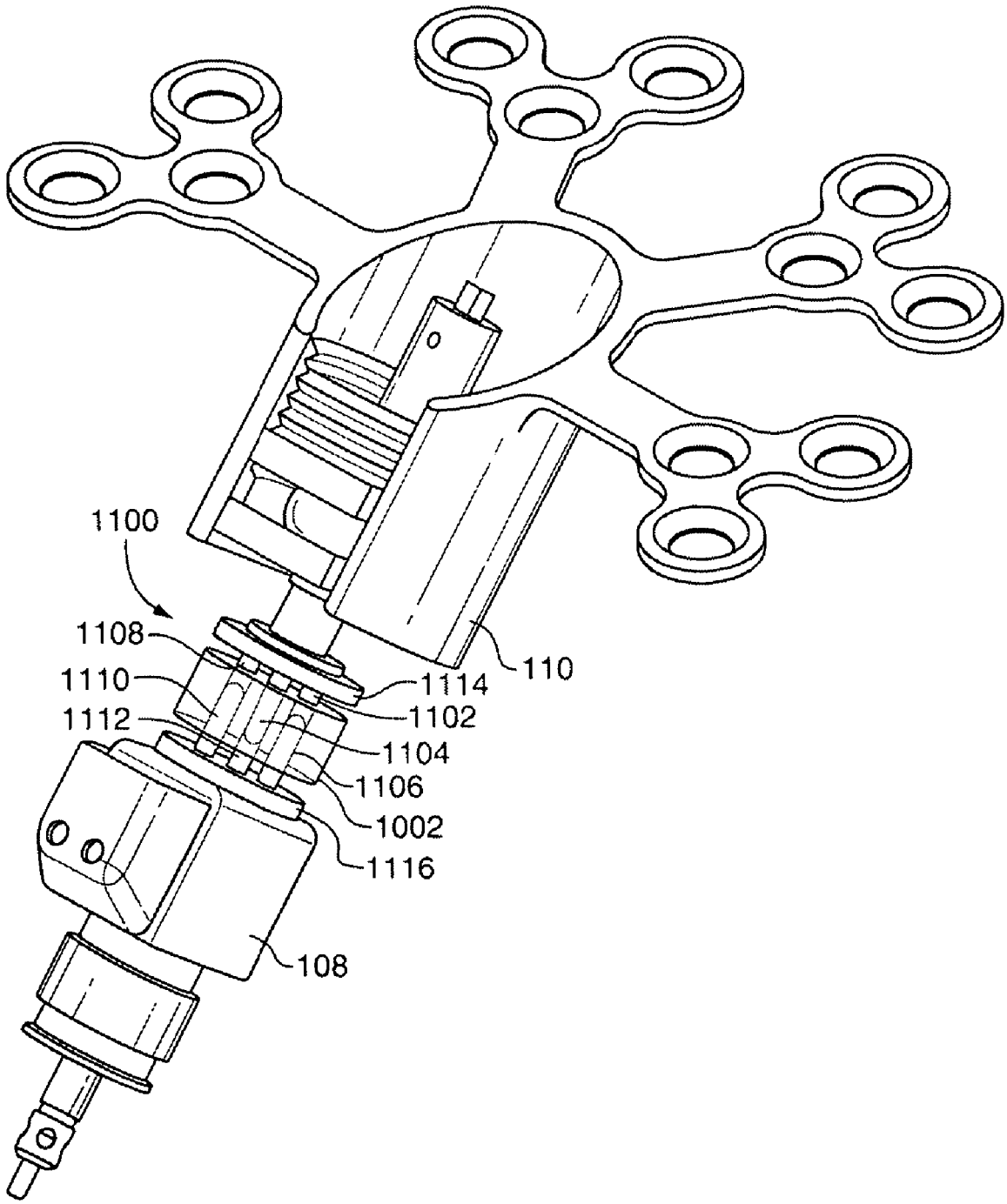
FIG. 11 illustrates another example of a compliant interface for an implantable transducer.

FIG. 11 illustrates another example of the compliant interface 120 according to the second aspect above, namely compliant interface 1100. The compliant interface 1100 includes a top and bottom circular plate 1114 and 1116 respectively, each having a plurality of anchors, 1102–1112. The anchors 1102–1112 extend vertically from the respective plates 1114 and 1116 and are embedded in a disk of viscoelastic material 1002, e.g. rubber or elastomer material, for coupling the transducer 108 to the mounting apparatus 110.

In this regard, material properties of viscoelastic materials are influenced by many parameters including frequency, temperature, dynamic strain rate, static pre-load, time effects such as creep and relaxation, ageing, and other irreversible effects. Advantageously, the present compliant interface is designed to have predeterminable stiffness and damping properties as a function of these parameters to provide supportable positioning of the transducer 108 relative to an interfaced auditory component, e.g. incus 124. In this regard, such supportable positioning is provided such that high frequency vibrations (e.g. in the audible frequency range) may be effectively communicated to the incus 124 during normal operation of the transducer 108, while the compliant interface isolates the mounting apparatus 110 from the same. Advantageously, this example provides the benefit that any swelling of the viscoelastic material 1002, such as may result from absorption of body fluids after implantation, will not tend to move the transducer 108 and produce an undesirable loading force on the incus 124.

As noted, it is desirable to provide a compliant interface that is operational to isolate the microphone 208 from transducer vibrations, while providing a stable interconnection between the transducer 108 and the mounting apparatus 110 for transmission of vibratory movements to the incus 124 in a controlled manner. Thus, a balance is required between the compliancy of the interface 1100 and the rigidity. In this regard, the number and geometric configuration of the anchors 1102–1112 may be varied to achieve a predeterminable damping coefficient and rigidity or stiffness in the interface 1100. This in turn, provides a tunable interface 1100 in relation to the operational parameters of the transducer 108. In other words, the actual frequency of vibrations emitted from a transducer, such as transducer 108, may vary according to the design and operational frequencies of that transducer. Thus, it may be desirable to tune, using different geometric configurations of the anchors 1102–1112, individual compliant interfaces on a patient specific basis, as the operating frequency of a specific transducer may vary according to a range and severity of hearing loss.

Figure 12:
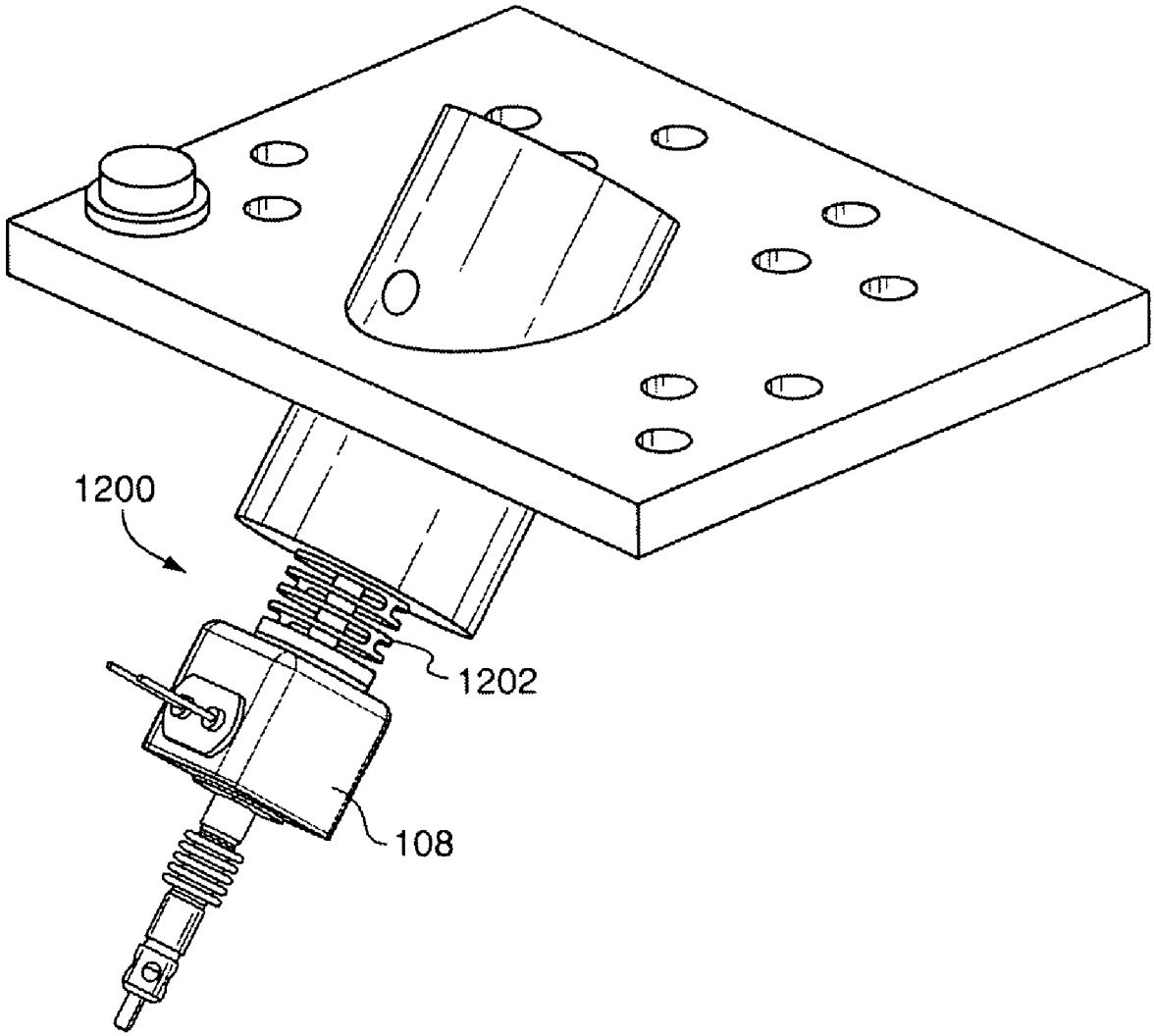
FIG. 12 illustrates another example of a compliant interface for an implantable transducer.

FIG. 12 illustrates another example of the compliant interface 120 according to the second aspect above, namely compliant interface 1200. The compliant interface 1200 includes a compliant member 1202, e.g. a spring. In this example, the compliant member 1202 is constructed from a hollow cylinder of preferably biocompatible material, e.g. titanium, with slots cut at predetermined intervals into the surface. In this regard, the individual slots may be cut at predeterminable rotations and widths relative to each other to achieve a variety of predeterminable spring rates in the compliant member 1202, which in turn provide predeterminable transmissibility coefficients. For instance, according to one example of the compliant member 1202, each of the individual slots may be rotated substantially 180° from the neighboring slot to provide a high degree of compliance, e.g. spring rate. In another instance a different spring rate may be achieved by slots oriented 90° to one another. In still yet another example of the compliant member 1202, the slots may be oriented substantially 60° relative to one another to achieve further differing spring rate.

It will be appreciated that a desired spring rate is at least partially dependent on a given mass of a transducer, such as transducer 108. Furthermore, it will be appreciated that a desired spring rate may at least partially depend on a given frequency range where isolation is most desired, e.g. a frequency range where feedback is most likely to occur (i.e. note that the feedback frequency range of concern is predeterminable for any given transducer). In this regard, the present inventors have recognized that for a known transducer system mass, a spring rate may be selectively established to reduce the natural, or resonant frequency of the transducer system below a predetermined frequency range of concern. In this context, a transducer system may be considered as including at least the transducer and compliant interface, as well as other components interconnected therebetween. Further in this regard, the present inventors have recognized that it is preferable that the natural frequency of the given transducer system be established to less than ½ the lowest frequency in the feedback frequency range of concern and more preferably to less than ⅕ the lowest frequency of the feedback frequency range of concern.

Figure 10:
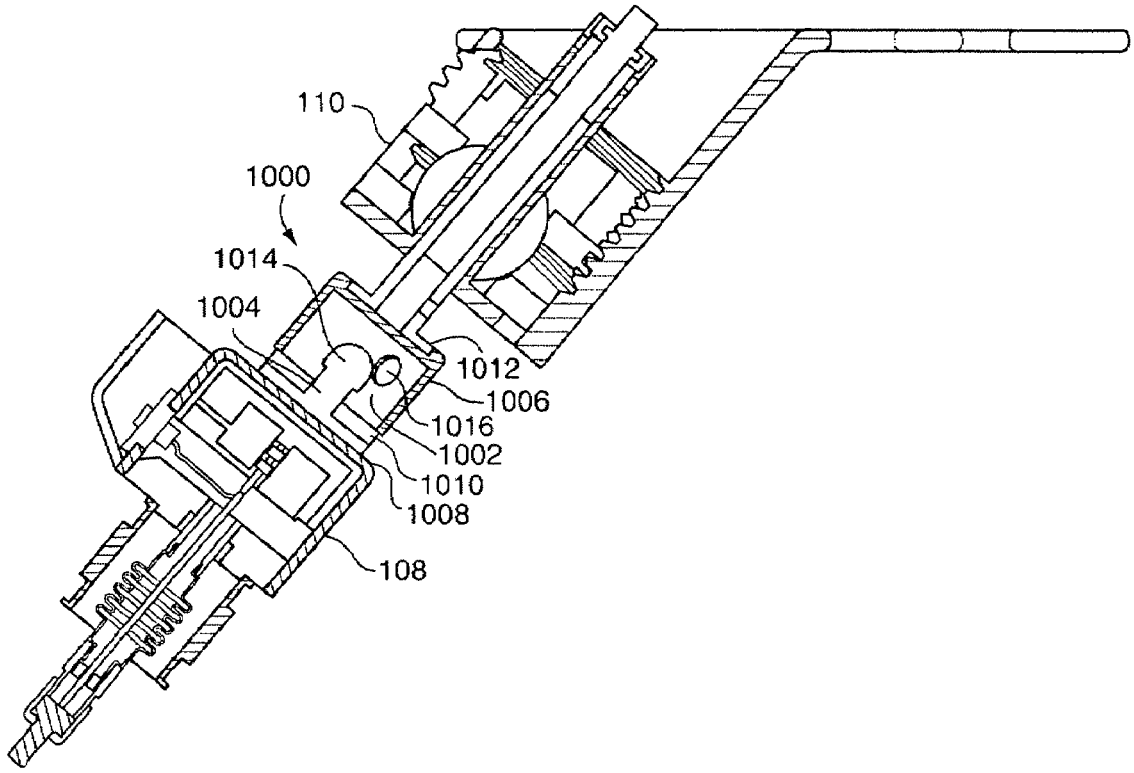
FIG. 10 illustrates another example of a compliant interface for an implantable transducer.

In relation to FIGS. 10–12, it is therefore desirable that the compliant interface, e.g. 1000, 1100, 1200, reduce the natural frequency of the transducer system (e.g. transducer 108 and compliant interface 1000) to reduce the intensity of vibration transmitted over the feedback path to the microphone 208, e.g. via the mounting apparatus 110, to less than the lowest feedback frequency level of concern for transducer 108. It is more desirable for that natural frequency to be established at less than ½ the lowest frequency in the feedback frequency range of concern, and most desirable that the natural frequency be established less than ⅕ the lowest frequency in the feedback frequency range of concern. For example, if the lowest frequency in the feedback frequency range of concern is 3000 Hz then it is desirable to establish a spring rate to reduce the natural frequency to less than 1500 Hz, and more desirably, to reduce the natural frequency to less than 600 Hz. In another example, if the lowest frequency in the feedback frequency range of concern is 2000 Hz then it is desirable to establish a spring rate to reduce the natural frequency to less than 1000 Hz, and more desirably, to reduce the natural frequency to less than 400 Hz.

Figure 13:
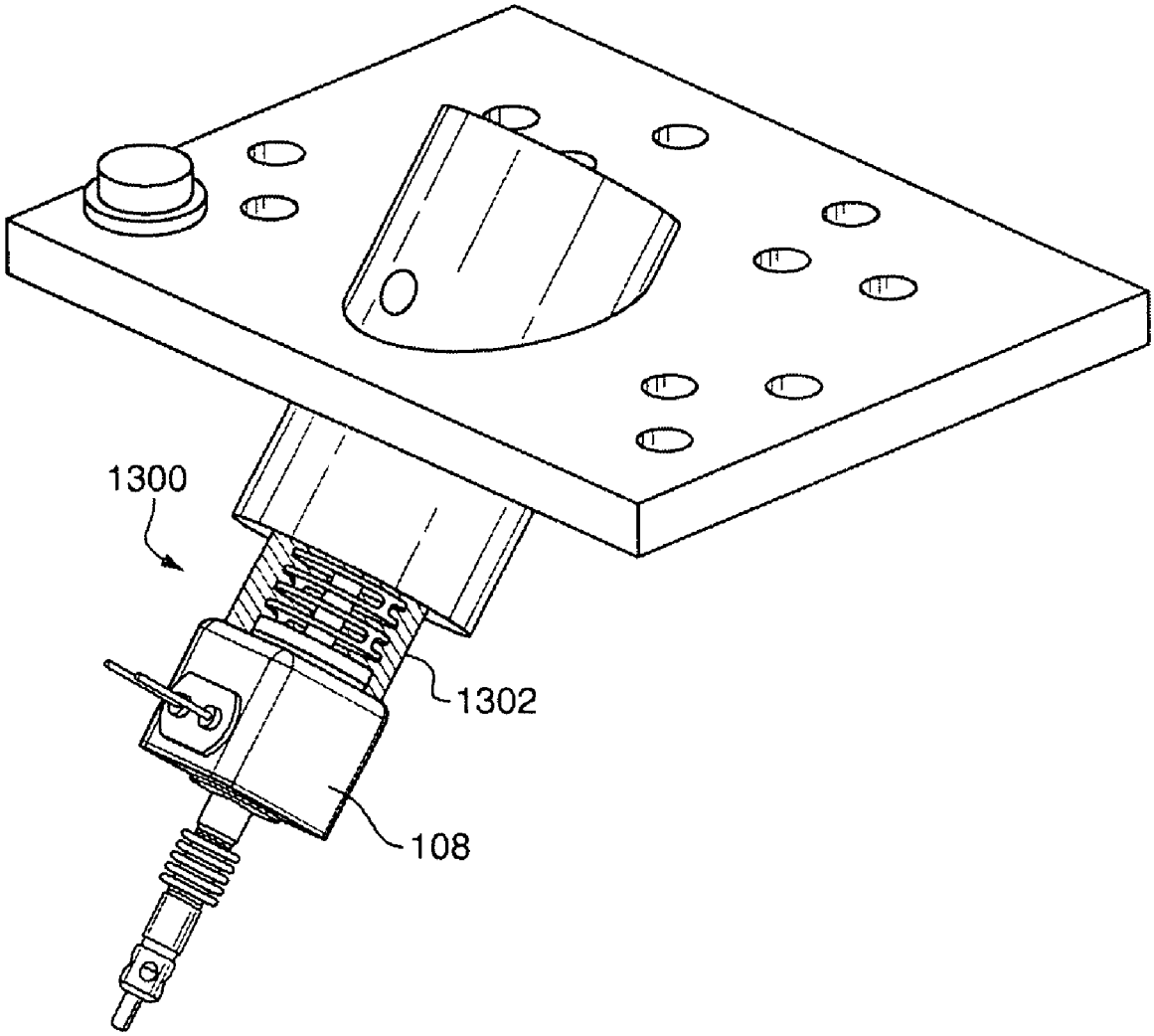
FIG. 13 illustrates another example of a compliant interface for an implantable transducer.

FIG. 13 illustrates another example of the compliant interface 120 according to the second aspect above, namely compliant interface 1300. The compliant interface 1300 is substantially similar to the compliant interface 1200 except that it includes an additional damper element 1302. In this case, the additional damper element 1302 is provided to enhance or facilitate, e.g. increase the damping, in the compliant interface 1300 to reduce the relative transmissibility of the same. In this regard, the damper element 1302 may be a viscoelastic material such as rubber or elastomer selected to reduce the relative transmissibility of the vibrations. Similarly to the embodiment shown in FIG. 12 and described above, the embodiment shown in FIG. 13 makes use of a tunable natural frequency of the system comprising transducer and compliant interface 1300. This natural frequency, and the damping coefficient of the material chosen for damper element 1302, governs the transmissibility of vibration to the microphone 208. In this regard, the relative transmissibility of vibrations is given by the following equation such that a predeterminable damping coefficient may be determined that prevents transmission of transducer vibrations to the microphone 208. In this case, the relative transmissibility of the vibration may be given by:

$$\mu_{rel} = \frac{\frac{\omega^2}{\omega_n^2}}{\sqrt{\left(1 - \frac{\omega^2}{\omega_n^2}\right)^2 + \frac{\delta^2}{\pi^2}}}$$

Where:

$\mu_{rel}$ is the relative transmissibility of vibration, $\omega$ is the angular frequency of vibration to be isolated, and $\omega_n$ is the natural frequency of the system comprising transducer and compliant interface 1300, and $\delta$ is a factor related to the damping coefficient c of the material and the frequency $\omega$ to be isolated, defined as $\delta=\pi\omega c$.

Those skilled in the art will appreciate variations of the above-described embodiments that fall within the scope of the invention. As a result, the invention is not limited to the specific examples and illustrations discussed above, but only by the following claims and their equivalents.

What is claimed is:

1. An implantable transducer system comprising:

an implantable transducer including a distal actuator to form a first contact relationship with an auditory component of a patient; and, a mounting apparatus for attaching the implantable transducer to a skull of the patient;

a compliant interface disposed between the mounting apparatus and the implantable transducer, at least a portion of the compliant interface having a predetermined spring rate selected to reduce vibrations to said mounting apparatus during stimulation of the transducer, wherein the predetermined spring rate is selected to establish a natural frequency of the transducer and the compliant interface which is less than a predetermined frequency, the predetermined frequency being in a feedback frequency range of between 20 hertz and 20,000 hertz.

2. The system of claim 1, wherein the predetermined spring rate is selected to establish a natural frequency of the transducer and the compliant interface which is less than one half the predetermined frequency.

3. The system of claim 1, wherein the predetermined spring rate is selected to establish a natural frequency of the transducer and the compliant interface which is less than one fifth the predetermined frequency.

4. The system of claim 1, wherein the predetermined spring rate is selected to establish a natural frequency of the transducer and the compliant interface which is less than 1500 hertz.

5. The system of claim 4, wherein the predetermined spring rate is selected to establish a natural frequency of the transducer and the compliant interface which is less than 1000 hertz.

6. The system of claim 5, wherein the predetermined spring rate is selected to establish a natural frequency of the transducer and the compliant interface which is less than 500 hertz.

7. The system of claim 1, wherein the compliant interface comprises a spring.

8. The system of claim 7, wherein the spring comprises a biocompatible material.

9. The system of claim 8, wherein the biocompatible material comprises titanium.

10. The system of claim 1, wherein at least another portion of the compliant interface is displaceable in response to a predeterminable type of transducer movement having a frequency of less than 20 hertz.

11. The system of claim 10, wherein the predeterminable type of transducer movement has a frequency of less than 5 hertz.

12. The system of claim 11, wherein the predeterminable type of transducer movement has a frequency of less than 1 hertz.

13. The system of claim 10, wherein the predeterminable type of transducer movement comprises movement in response to a physiological movement.

14. The system of claim 10, wherein the compliant interface comprises a spring.

15. The system of claim 14, wherein the spring comprises a biocompatible material.

16. The system of claim 15, wherein the biocompatible material comprises titanium.

17. The system of claim 1, wherein said implantable transducer is disposed to pivotably interface with said compliant interface.

18. An implantable transducer system comprising:

an implantable transducer including a distal actuator to form a first contact relationship with an auditory component of a patient;

a mounting apparatus for attaching the implantable transducer to a skull of the patient; and, a compliant interface disposed between the mounting apparatus and the implantable transducer to reduce vibrations to said mounting apparatus during stimulation of the transducer, wherein said implantable transducer is disposed to pivotably interface with said compliant interface.

19. The system of claim 18, wherein at least a portion of the compliant interface has a predetermined spring rate selected to establish a natural frequency of the transducer and the compliant interface which is less than a predetermined frequency, said predetermined frequency being in a feedback range of between 20 hertz and 20,000 hertz.

20. The system of claim 19, wherein another portion of the compliant interface is displaceable in response to a predeterminable type of transducer movement having a frequency of less than 20 hertz.

* * * * *